US012096844B2

(12) United States Patent
Huy

(10) Patent No.: US 12,096,844 B2
(45) Date of Patent: Sep. 24, 2024

(54) BRISTLES HAVING ORAL CARE ADDITIVES CONTAINED THEREIN AND ASSOCIATED METHODS OF MANUFACTURE

(71) Applicant: Church & Dwight Co., Inc., Princeton, NJ (US)

(72) Inventor: Gerhart Huy, Hamilton Square, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 55 days.

(21) Appl. No.: 17/556,465

(22) Filed: Dec. 20, 2021

(65) Prior Publication Data

US 2022/0192358 A1 Jun. 23, 2022

Related U.S. Application Data

(60) Provisional application No. 63/128,429, filed on Dec. 21, 2020.

(51) Int. Cl.

| | |
|---|---|
| ***A46B 11/00*** | (2006.01) |
| ***A46B 3/04*** | (2006.01) |
| ***A46D 1/00*** | (2006.01) |

(52) U.S. Cl.

CPC ..... *A46B 11/0072* (2013.01); *A46B 3/04* (2013.01); *A46B 11/0041* (2013.01); *A46D 1/006* (2013.01); *A46D 1/023* (2013.01); *A46B 2200/1066* (2013.01)

(58) Field of Classification Search

CPC ..... A46B 2200/1066; A46B 11/0072; A46D 1/006; A46D 1/02; A46D 1/023; A46D 9/04

USPC ..... 15/167.1

See application file for complete search history.

(56) References Cited

U.S. PATENT DOCUMENTS

| | | | |
|---|---|---|---|
| 6,838,403 | B2 | 1/2005 | Tsai et al. |
| 7,267,789 | B2 | 9/2007 | Chhabra et al. |
| 8,632,268 | B2 | 1/2014 | Kemp |
| 8,734,042 | B2 | 5/2014 | Hohlbein et al. |
| 8,967,162 | B2 | 3/2015 | Ewing |
| 9,492,005 | B2 | 11/2016 | Kemp |
| 9,681,743 | B2 | 6/2017 | Xi et al. |
| 9,888,988 | B2 | 2/2018 | Kohli et al. |

(Continued)

FOREIGN PATENT DOCUMENTS

| | | |
|---|---|---|
| EP | 2758567 B1 | 3/2017 |
| EP | 2732803 B1 | 4/2018 |

(Continued)

OTHER PUBLICATIONS

KR101722691B1 translation (Year: 2015).*

*Primary Examiner* — Abbie E Quann

(74) *Attorney, Agent, or Firm* — Church & Dwight Co., Inc.

(57) ABSTRACT

The disclosure provides dental hygiene devices including a plurality of bristles in the form of polymer fibers, the polymer fibers having a plurality of microcapsules positioned within at least a portion of the polymer fibers, and the plurality of microcapsules comprising an oral care additive surrounded by a shell configured as one or a plurality of layers. In some aspects, the present disclosure provides processes and methods for forming toothbrush bristles including an oral care additive contained therein.

15 Claims, 5 Drawing Sheets

(56) References Cited

U.S. PATENT DOCUMENTS

| | | | | |
|---|---|---|---|---|
| 10,087,555 | B2 | 10/2018 | Bornemann et al. | |
| 10,278,485 | B2 | 5/2019 | Hohlbein et al. | |
| 10,299,580 | B2 * | 5/2019 | Xi | A46D 1/0284 |
| 10,477,958 | B2 | 11/2019 | Xi et al. | |
| 2014/0259486 | A1 | 9/2014 | Petrovicova et al. | |
| 2014/0325777 | A1 | 11/2014 | Chang | |
| 2017/0020275 | A1 | 1/2017 | Xi et al. | |
| 2017/0065070 | A1 | 3/2017 | Hohlbein et al. | |
| 2017/0349446 | A1 * | 12/2017 | Savary | C01D 7/22 |
| 2018/0317644 | A1 | 11/2018 | Xi et al. | |
| 2018/0371687 | A1 | 12/2018 | Stark et al. | |
| 2020/0146431 | A1 | 5/2020 | Davies-Smith et al. | |

FOREIGN PATENT DOCUMENTS

| | | | |
|---|---|---|---|
| EP | 3443057 | B1 | 10/2021 |
| JP | 11216016 | A | 8/1999 |
| KR | 101722691 | B1 * | 11/2015 |
| KR | 10-2017-0055010 | A | 5/2017 |
| KR | 10-2018-0057236 | A | 5/2018 |
| KR | 10-2018-0100520 | A | 9/2018 |
| WO | WO2019/039784 | A1 | 2/2019 |
| WO | WO2019/039785 | A1 | 2/2019 |
| WO | WO2020/168359 | A1 | 8/2020 |

* cited by examiner

BRISTLES HAVING ORAL CARE ADDITIVES CONTAINED THEREIN AND ASSOCIATED METHODS OF MANUFACTURE

FIELD OF THE DISCLOSURE

The present disclosure relates to bristle filaments or tufts for use with a personal hygiene device, such as a toothbrush for cleaning one's teeth and/or gums, and methods of manufacturing the same, wherein the bristle filaments or tufts have an oral care additive positioned therein.

BACKGROUND

There are multiple benefits of brushing teeth with oral care additives such as sodium bicarbonate. For example, use of sodium bicarbonate (baking soda) in dentifrice compositions has the known ability to whiten teeth and provide a brighter smile. In addition to these noted benefits, by attacking plaque formation, baking soda prevents dental decay, cavity formation, and gum diseases. Further, baking soda compositions, when used in oral applications such as brushing teeth, can fight bad breath by balancing the acidic levels of residual food that become lodged in the teeth. It is well known in the oral care industry that baking soda can be incorporated into various dentifrice compositions to provide some of the noted benefits during brushing. However, use of baking soda in dentifrice compositions is sometimes associated with an objectionable flavor being transferred to the user.

One recent addition in the oral care industry has been incorporating oral care additives into a toothbrush directly. Some toothbrushes have been equipped with internal reservoirs and systems for delivering dentifrice to a user's oral cavity. Other toothbrushes have been developed that include dentifrice that is pre-coated onto the bristles. Such toothbrush bristles are generally designed to deliver such oral additives directly to the mouth of a user of said toothbrush during use thereof. However, typical toothbrush bristles are formed of plastic or polymer materials and methods of forming toothbrush bristles generally known in the art require elevated temperatures to melt the plastic or polymer prior to extruding the plastic or polymer material to form individual bristle filaments therefrom. Thus, it has previously been difficult to incorporate various oral care additives, such as baking soda, into toothbrush bristles during the manufacturing process because exposure of said oral care additives to these elevated processing temperatures can cause the oral care additive to break down and/or dissolve during manufacture of the bristles.

Accordingly, there is still a need and desire to provide further teeth cleaning instruments with oral care additives included therewith as well as improved methods and processes for incorporating oral care additives into toothbrush bristles during the manufacturing process of said bristles.

SUMMARY OF THE INVENTION

The present disclosure relates to bristle filaments or tufts for use with a personal hygiene device, and more particularly, a toothbrush for cleaning one's teeth and/or gums, wherein one or more oral care additives are provided with the device, such as having been combined with the bristle filaments or tufts during the manufacture thereof. In some embodiments, the bristle filaments or tufts may include milled sodium bicarbonate that has microencapsulated and combined with (e.g., infused into) polymer-based bristle filaments or tufts during the manufacturing process.

Some aspects of the present disclosure relate to a toothbrush including a brush head, a plurality of bristles in the form of polymer fibers attached to the brush head, and a plurality of microcapsules positioned within at least a portion of the polymer fibers, the plurality of microcapsules comprising an oral care additive surrounded by a shell configured as one or a plurality of layers. In further embodiments, the toothbrush and/or portions thereof may be defined in relation to one or more of the following statements, which may be combined in any number or order.

The polymer fibers may be formed of a polymer selected from the group consisting of nylon, polybutylene terephthalate (PBT), or a combination thereof.

The plurality of microcapsules may include one or more oral care additives therein.

The oral care additive may comprise sodium bicarbonate.

The sodium bicarbonate may have an average particle size of about 5 microns or less.

The microcapsules may have an average size of about 5 microns or less.

The shell of the plurality of microcapsules includes two layers configured such that each of the two layers comprises a non-water soluble fatty acid.

Each of the two layers of the shell may have a melting point of at least about 175° C.

The shell of the plurality of microcapsules is rupturable under typical tooth brushing forces (e.g., such as in response to contact with and/or friction created when rubbing against a user's teeth).

The shell of the plurality of microcapsules is not water soluble.

The plurality of bristles may be in the form of polymer fibers attached to the brush head.

The polymer fibers may be multicomponent fibers.

The multicomponent fibers may include an outer sheath or matrix component and an inner core component or a plurality of island components, such that the multicomponent fibers are in a sheath/core arrangement or an islands-in-the-sea arrangement, respectively.

The plurality of microcapsules (containing an oral care additive) may be positioned within at least a portion of the polymer fibers may be positioned within the inner core component or the plurality of island components.

The outer sheath or matrix component and the inner core component or plurality of island components may be formed of the same, or different, polymer fibers.

The plurality of bristles may be attached directly to the brush head or a component thereof.

Another aspect of the present disclosure relates to methods of forming toothbrush bristles including an oral care additive. For example, such methods may include mixing a plurality of microcapsules with a flowable polymer to provide a mixture of the flowable polymer with the plurality of microcapsules included therein, each of the plurality of microcapsules comprising an oral care additive surrounded by a shell configured as one or a plurality of layers; and extruding the mixture of the flowable polymer with the plurality of microcapsules included therein to provide one or more solid filaments having the plurality of microcapsules included therein. In further embodiments, the methods described herein may be defined in relation to one or more of the following statements, which may be combined in any number or order.

The flowable polymer comprises nylon, polybutylene terephthalate (PBT), or a combination thereof.

The mixture of the flowable polymer with the plurality of microcapsules included therein is at a temperature in the range of about 240° C. to about 260° C. prior to said extruding.

The shell of the plurality of microcapsules may include two layers configured such that each of the two layers comprises a non-water soluble fatty acid.

Each of the two layers may be water insoluble.

Each of the two layers may have a melting point of at least about 175° C.

The plurality of microcapsules may have an average size of about 5 microns or less.

The oral care additive may include sodium bicarbonate.

The method may further include milling the sodium bicarbonate to provide particles having an average particle size of about 5 microns or less.

The method may further comprise, prior to said mixing, forming the plurality of microcapsules.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWING

Figure 1A:
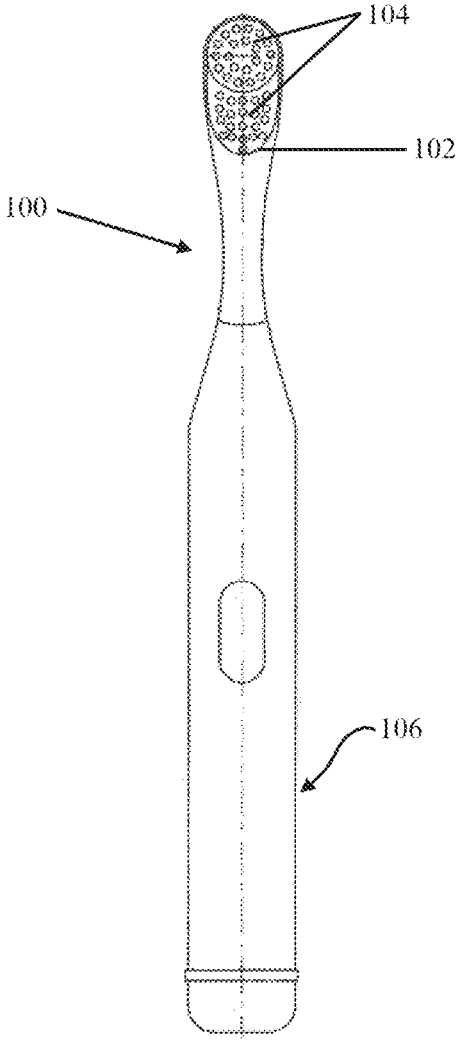

Having thus described aspects of the disclosure in the foregoing general terms, reference will now be made to the accompanying drawing, which is not necessarily drawn to scale. The drawing is exemplary only, and should not be construed as limiting the disclosure.

Figure 1B:
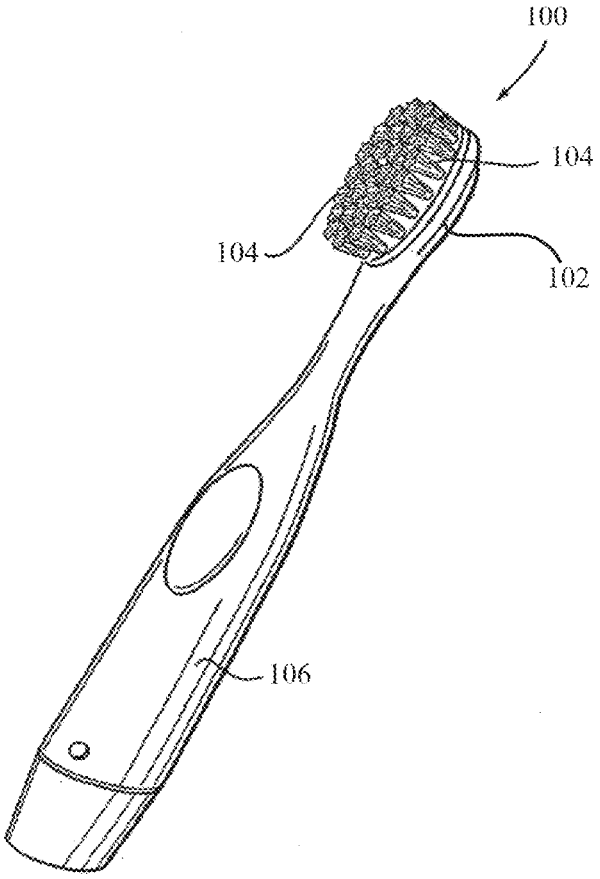
Figure 2B:
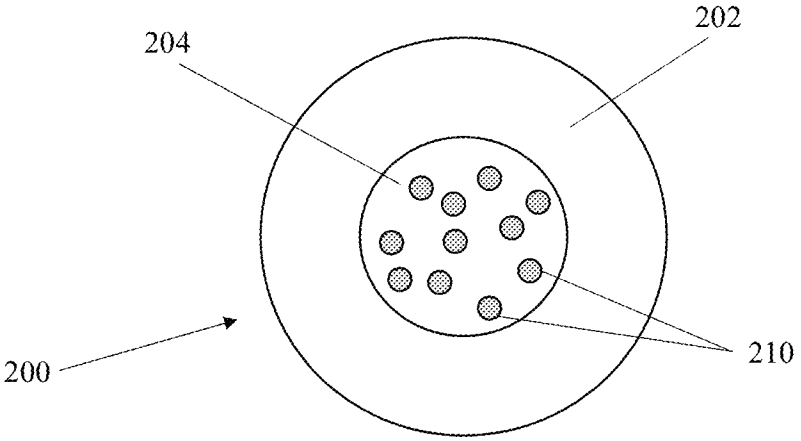
Figure 2C:
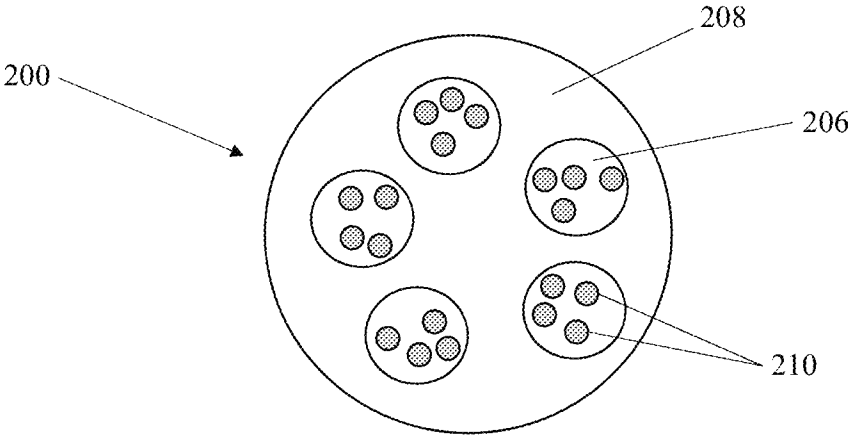
Figure 2A:
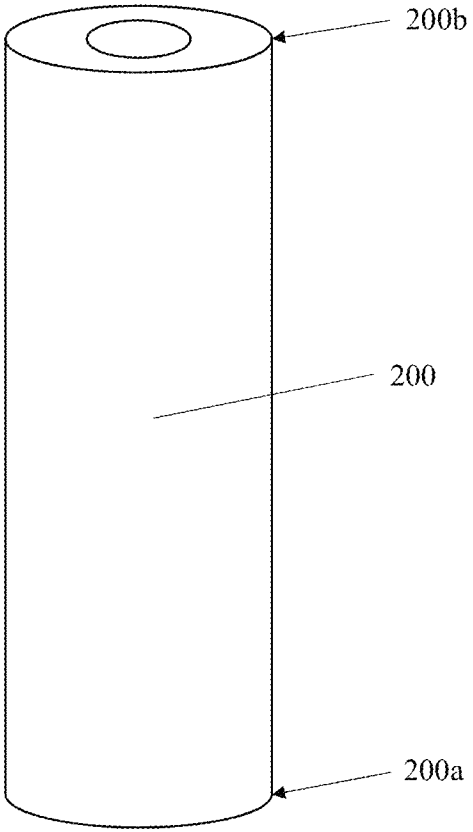
Figure 3:
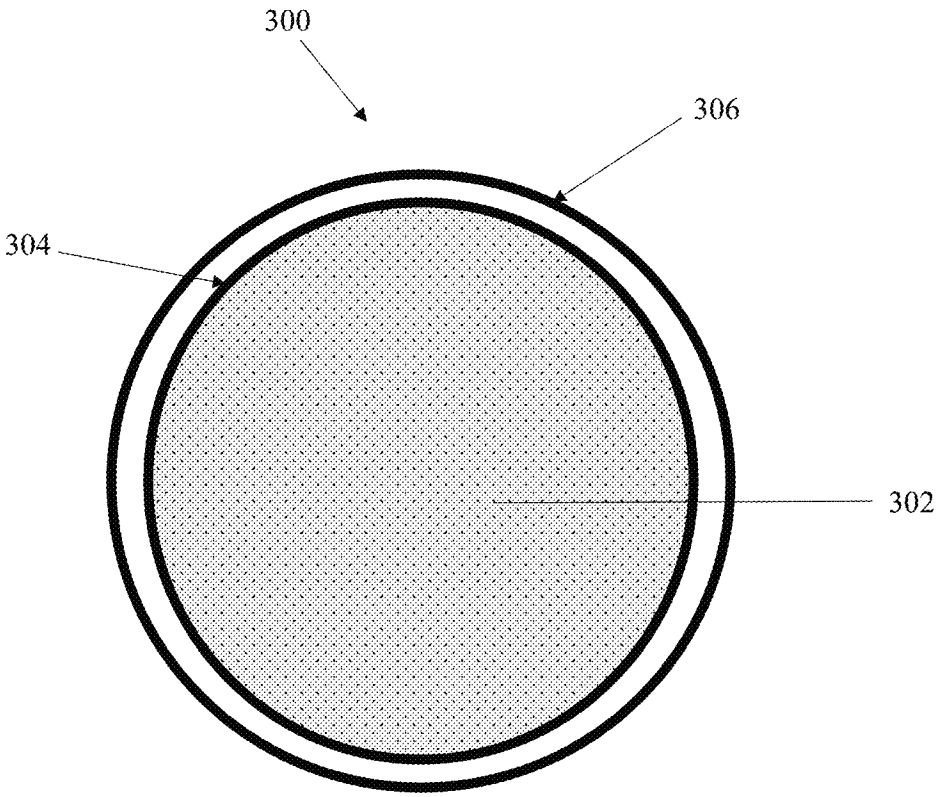
Figure 4B:
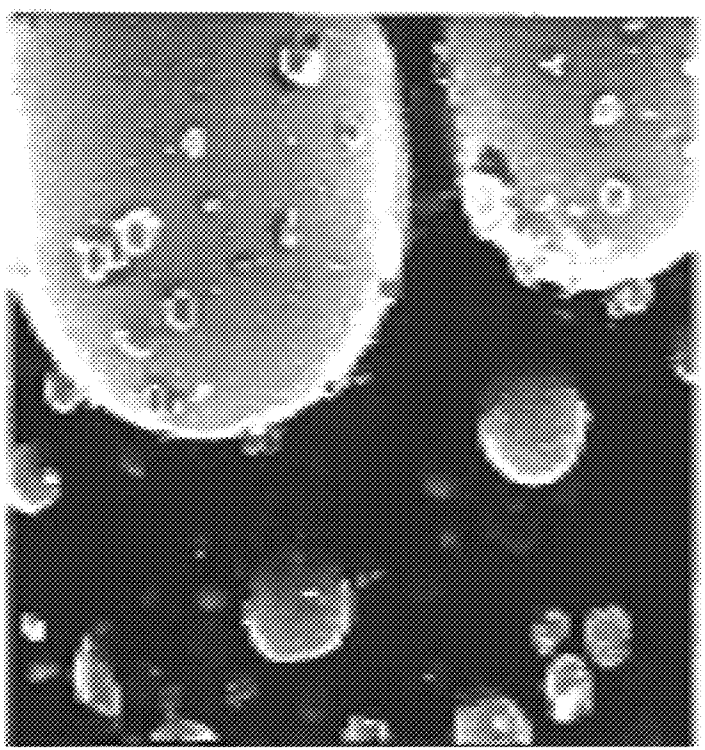
Figure 4A:
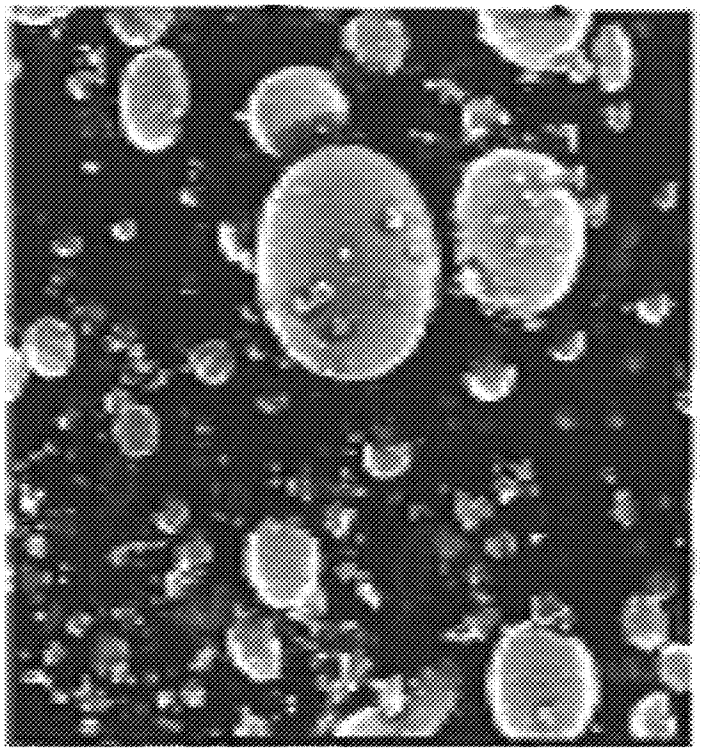
Figure 5:
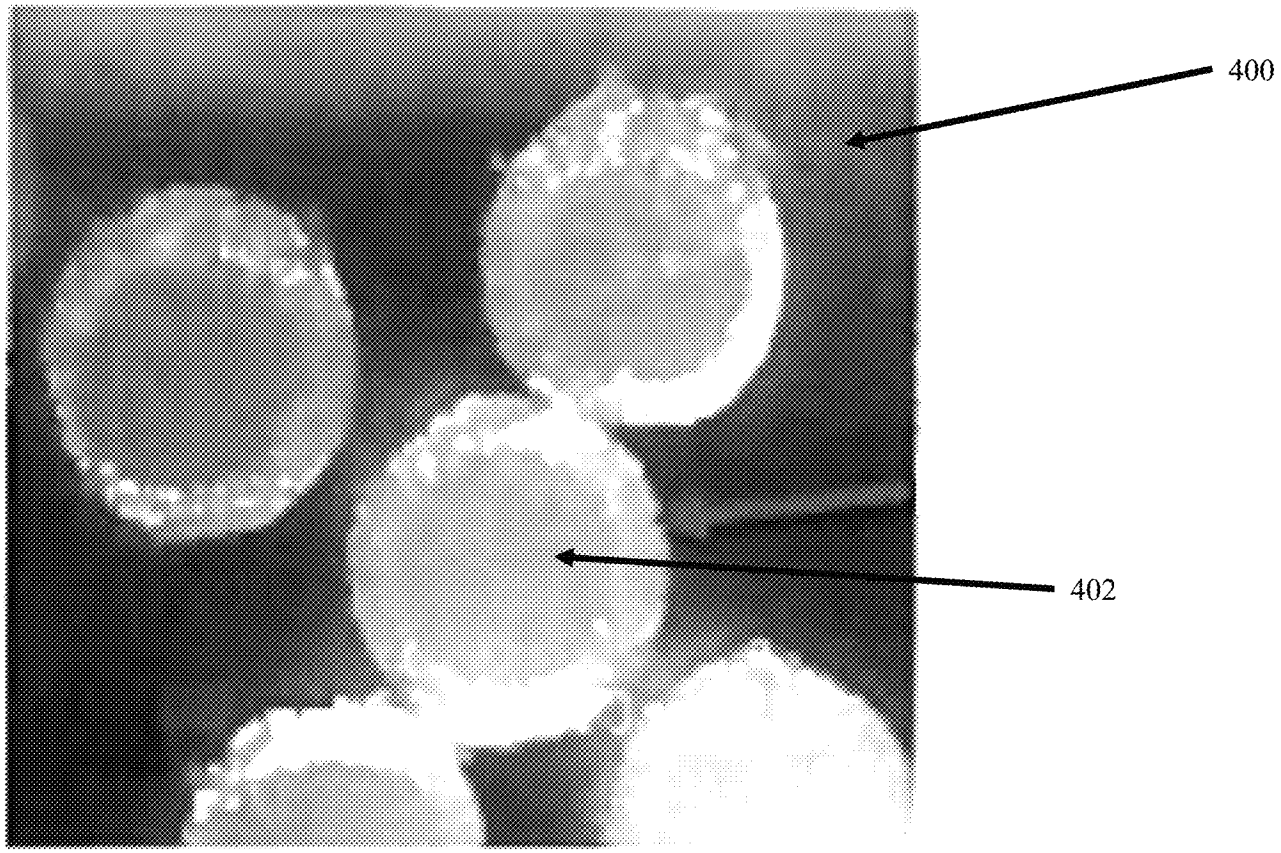

FIG. 1A is a front perspective view illustrating a toothbrush, according to an example embodiment of the present disclosure;

FIG. 1B is a side perspective view illustrating a toothbrush, according to an example embodiments of the present disclosure;

FIG. 2A is an enlarged side perspective view illustrating an individual bristle filament formed of a multicomponent polymer fiber, according to an example embodiment of the present disclosure, the bristle extending along a longitudinal axis between opposing ends;

FIG. 2B is a top perspective view illustrating a cross-section of a multicomponent polymer fiber having a sheath/core arrangement, according to an example embodiment of the present disclosure, the cross-section being transverse to a longitudinal axis of the bristle, and the core of the fiber having particles of an oral care additive included therein;

FIG. 2C is a top perspective view illustrating a cross-section of a multicomponent polymer fiber having an islands-in-the-sea arrangement, according to an example embodiment of the present disclosure, the cross-section being transverse to a longitudinal axis of the bristle, and the core of the fiber having particles of an oral care additive included therein;

FIG. 3 is a top perspective view illustrating a cross section of a microcapsule having an oral care additive surrounded by a shell configured as a plurality of layers, according to an example embodiment of the present disclosure;

FIG. 4A and FIG. 4B provide Scanning Electron Microscopy (SEM) images showing a plurality of microcapsules, each microcapsule being formed of one or more shells surrounding an oral care additive (e.g., sodium bicarbonate), according to an example embodiment of the present disclosure, FIG. 4A being at a first magnification, and FIG. 4B being at a second, greater magnification; and FIG. 5 is an enlarged cut-away view illustrating a portion of a polymer fiber having a plurality of microcapsules positioned within at least a portion of the polymer fiber, according to an example embodiment of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise.

Some aspects of the present disclosure relate to bristle filaments or tufts for use with a personal hygiene device, and more particularly, a toothbrush for cleaning one's teeth and/or gums, that that utilize an oral care additive, such as sodium bicarbonate, that has been combined with the polymer material used in forming the bristle filaments or tufts. In some embodiments, the present disclosure provides a toothbrush comprising at least a brush head, a plurality of bristles in the form of polymer fibers attached to the brush head, and a plurality of microcapsules positioned within at least a portion of the polymer fibers, the plurality of microcapsules comprising an oral care additive surrounded by a shell configured as one or more layers, and preferably a plurality of layers.

FIGS. 1A and 1B, for example, depict two example embodiments of a toothbrush according to the present disclosure. As depicted in FIGS. 1A and 1B, a toothbrush 100 may include a brush head 102 and a plurality of bristles in the form of polymer fibers 104 (e.g., as used herein the terms "bristle", "bristles", "fiber", "fibers", "filament", and "filaments" are intended to be interchangeable) attached to the brush head 102. Generally, the configuration of the brush head and the plurality of bristles attached thereto can vary, and any specific arrangement and/or configuration of the plurality of bristles on the brush head is suitable. For example, in some embodiments, the arrangement of the bristles tufts, bristle hardness, geometry, and three dimensional orientations can be varied. In some embodiments, the plurality of bristles may be connected or attached to the brush head. For instance, the plurality of bristles can be positioned in various patterns on the brush head and grouped or mixed according to hardness, thickness and/or length. The plurality of bristles may be oriented in a vertical configuration normal to the brush head surface or angularly off-set from the vertical relative to the brush head. In still other embodiments, the plurality of bristles may not necessarily be attached directly to the brush head. For example, in some embodiments described herein, the brush head may include one or more additional components therein or positioned thereon (e.g., such as one or more movable plates, bristle support members, and the like). In such embodiments, the plurality of bristles may be attached to the one or more additional components in the brush head rather than engaging the brush head directly.

In addition, the toothbrush may optionally comprise one or more additional components, e.g., such as a handle portion (e.g., which is detachably or permanently engaged with the brush head), a neck portion (e.g., connecting a handle portion to a brush head portion), one or more internal components within the handle portion and/or the brush head and/or external components attached thereto (e.g., such as a battery, a motor, buttons, switches, a translation head, one or more bristle plates or bristle support members, other mechanical components, and the like), and various other components as would be understood by a person of ordinary skill in the art. In some embodiments, for example, the toothbrush may optionally include a handle portion 106 (e.g., as depicted in FIG. 1) that is either permanently or detachably coupled with brush head. In such embodiments, the handle portion and the brush head may form a one-piece design, for example, wherein the brush head portion and the handle portion are permanently connected forming a singular elongated body. In other embodiments, the brush head and the handle portion may represent two separate and distinct components of the toothbrush. For example, in such embodiments, the brush head section and the handle portion may be adapted for engagement therebetween. Such an engagement may be in the form of a screw-fit engagement, a press fit engagement, a magnetic engagement, a snap-fit engagement, or any other type of engagement suitable for forming a connection between the brush head portion and the handle portion. In such embodiments, the toothbrush may form a singular elongated body when engaged.

In still further embodiments, the tooth brush may comprise one or more other components within the brush head and/or the handle portion (e.g., such as a drive rod or a translation head) that facilitate movement of the plurality of bristles, for example, linearly and/or rotationally. In some embodiments, the plurality of bristles may independently, be configured for movement thereof, e.g., either linearly or rotationally. In such embodiments, the toothbrush may be characterized as having a "dual-action" and/or "multi-action" brush head which is capable of providing independent movement of two or more sections of bristles positioned thereon. Some examples of brush head sections, and in particular dual-action brush head sections, suitable for use in toothbrushes as described herein are described in more detail, for example, in U.S. Pub. Pat. App. No. 2016/0199165 to Nikitczuk and U.S. Pat. No. 6,360,395 to Blaustein, which is incorporated by reference herein in its entirety.

As noted above, the plurality of bristles 104 are in the form of polymer fibers. The orientation or configuration of the polymer fibers forming the plurality of bristles may vary, for example, multiple groups of polymer fibers (e.g., each group being referred to as a "bristle tuft") may be independently positioned at various locations on the exterior of the brush head as described herein above. As used herein, the term "fibers" is defined as a basic element of textiles. Fibers are often in the form of a rope- or string-like element. As used herein, the term "fiber" is intended to include fibers, filaments, continuous filaments, staple fibers, and the like. Examples of suitable polymer fibers include, but are not limited to, nylon and polybutylene terephthalate (PBT) and combinations thereof. In some embodiments, for example, the polymer fibers may comprise nylon, e.g., such as nylon 6.12 in particular.

FIG. 2A, for example, illustrates an enlarged side perspective view of an individual polymer fiber, in the form of a multicomponent fiber, according to the present disclosure, designated generally as 200. As illustrated, the fiber can be substantially elongated so as to extend along a longitudinal axis between a first end 200*a* and a second end 200*b*. In some embodiments, one end of the polymer fiber (i.e., the first end 200*a*) is attached to the brush head or a component thereof and the opposing end (i.e., the second end 200*b*) is free. Generally, the polymer fibers used in forming the plurality of bristles according to the present disclosure can vary, and include polymer fibers having any type of cross-section, including, but not limited to, circular, rectangular, square, oval, triangular, and multilobal. In certain embodiments, the polymer fibers can have one or more void spaces, wherein the void spaces can have, for example, circular, rectangular, square, oval, triangular, or multilobal cross-sections. In some embodiments, the polymer fibers can be selected from single-component (i.e., uniform in composition throughout the fiber) or multicomponent fiber types including, but not limited to, polymer fibers having a sheath/core structure and fibers having an islands-in-the-sea structure, as well as fibers having a side-by-side, segmented pie, segmented cross, segmented ribbon, or tipped multilobal cross-sections.

In some embodiments, the polymer fibers forming the plurality of bristles will have multicomponent arrangements. For example, the polymer fibers may be in the form of multicomponent fibers. The term "multicomponent fibers" refers to fibers that comprise two or more components that are different by physical or chemical nature, including bicomponent fibers. Specifically, the term "multicomponent fibers" includes staple and continuous fibers prepared from one or more polymers present in discrete structured domains in the fiber, as opposed to blends where the domains tend to be dispersed, random or unstructured. In some embodiments, each component of the multicomponent fibers can include the same polymer fibers, or different polymer fibers, as desired.

In preferred embodiments, the polymer fibers will have a multicomponent arrangement that is either a sheath/core arrangement or an islands-in-the-sea arrangement. FIG. 2B illustrates a cross sectional view of a multicomponent polymer fiber 200 having a sheath/core arrangement. For example, a sheath/core fiber typically includes at least two structured components: (i) an outer sheath component 202; and (ii) an inner core component 204. FIG. 2C, illustrates an embodiment wherein the multicomponent polymer fiber 200 has a "matrix" or "islands-in-the-sea" type arrangement. For example, an islands-in-the-sea fiber typically includes a plurality of inner, or "island," components 206 surrounded by an outer matrix, or "sea," component 208. The island components can be substantially uniformly or randomly arranged within the matrix of the sea component, and the number of islands present within the multicomponent fiber can vary (e.g., 2 or more, 3 or more, 4 or more, 5 or more, or the like, and preferably 2 to 10, 3 to 9, or 4 to 8 islands).

A toothbrush according to the present disclosure may include bristles that comprise one or a plurality of oral care additives positioned within at least a portion of the polymer fibers forming the bristles. As further discussed herein, the oral care additive may be provided as a plurality of particles or may be provided in a liquid form. When in particulate form, one or a plurality of particles may be provided in an encapsulated form. Likewise, liquid additives are preferably encapsulated so that the liquid is not prematurely released from the bristles. In particular embodiments, the oral care additives can be provided as plurality of microcapsules wherein the oral care additive is surrounded by a shell configured as a single layer or as a plurality of layers. When the oral care additive is in a particulate form, a single particle may be surrounded by the one or more layers as an individual microencapsulated component. Likewise, a microencapsulated component may be formed of a plurality of particles that are included within a single shell formed as one or more layers.

As noted above, the polymer fibers can be selected from single-component (i.e., uniform in composition throughout the fiber) or multicomponent fiber types. In embodiments having multicomponent fiber types, for example, the oral care additives, provided as a plurality of particles and/or as a plurality of microcapsules, may be positioned within a singular component of the multicomponent fiber or within multiple components of the multicomponent fiber. As noted above, in some embodiments, the polymer fibers may preferably have a multicomponent arrangement that is either a sheath/core arrangement or an islands-in-the-sea arrangement. FIGS. 2B and 2C, for example, depict a sheath/core fiber arrangement having the plurality of microcapsules 210 positioned completely within the core component 204 (see, e.g., FIG. 2B) and an islands-in-the-sea arrangement having the plurality of microcapsules 210 positioned completely within the inner island components 206 (see, e.g., FIG. 2C). Without intending to be bound by theory, it should be noted that positioning the plurality of microcapsules within the core and/or inner island component of the multicomponent fibers advantageously provides improved manufacturability of the polymer fibers during the heating and extrusion process, as will be discussed further herein. The present disclosure, however, does not necessarily exclude the options for providing the oral care additives within the sheath/sea component and/or providing one type of oral care additive in the sheath/sea and providing a different type of oral care additive in the core/islands.

FIG. 3 depicts a microcapsule 300 comprising an oral care additive 302 surrounded by a shell comprising two distinct layers, e.g., a first (or inner) layer 304 and a second (or outer) layer 306. It is understood that while two layers are illustrated, additional layers are also envisioned. Likewise, a single layer may be used as the shell as processing conditions may warrant. As used herein, the term "oral care additive" refers to any composition known to provide benefits to a user's oral health. Non-limiting examples of oral care additives as described herein include sodium bicarbonate (i.e., baking soda); lotus seed; lotus flower, bamboo salt; jasmine; corn mint; camellia; aloe; gingko; tea tree oil; xylitol; sea salt; vitamin C; ginger; cactus; pine tree salt; green tea; white pearl; black pearl; charcoal powder; nephrite or jade and $Ag/Au^{+}$. In certain embodiments, the oral care additive may comprise sodium bicarbonate. It is also understood that any one or more of the foregoing materials may be expressly excluded according to the present disclosure. Likewise, the present articles may be defined in relation to an oral care additive "consisting of" or "consisting essentially of" only one of the foregoing materials.

In some embodiments, the oral care additive may be incorporated into the polymer fibers in an amount of at least about 0.1% by weight, at least about 0.5% by weight, at least about 1.0% by weight, at least about 2% by weight, at least about 5% by weight, at least about 10% by weight, at least about 15% by weight, at least about 20% by weight, or at least about 25% by weight, based on the total weight of the polymer fiber (including the oral care additive and any encapsulating material).

In some embodiments, the oral care additive (e.g., such as sodium bicarbonate) may be in the form of a milled oral care additive. For example, the oral care additive may be milled prior to being encapsulated to provide particles of the oral care additive that are of sufficiently small size to be incorporated into the polymer fibers. In some embodiments, a particulate oral care additive, such as sodium bicarbonate, may have an average particle size in the range of about 1 to about 10 microns, or about 2.5 to about 5 microns. In some embodiments, a particulate oral care additive, such as sodium bicarbonate, may have an average particle size of about 10 microns or less, about 7.5 microns or less, about 5 microns or less, or about 2.5 microns or less (e.g., down to a technologically feasible minimum, such as about 0.1 microns).

Generally, the shell of the microcapsules may be formed of a variety of different materials and using a variety of methods commonly known in the art. For example, the microcapsules may be formed using any food grade encapsulation method commonly known in the art. As further examples, microcapsules can be formed using any of various chemical encapsulation techniques such as solvent evaporation, solvent extraction, organic phase separation, interfacial polymerization, simple and complex coacervation, in-situ polymerization, liposome encapsulation, and nanoencapsulation. Alternatively, physical methods of encapsulation can be used, such as spray coating, pan coating, fluid bed coating, annular jet coating, spinning disk atomization, spray cooling, spray drying, spray chilling, stationary nozzle coextrusion, centrifugal head coextrusion, or submerged nozzle coextrusion Regardless of the encapsulation methodology employed, the outer wall or shell material and solvents used to form the capsules can vary. Classes of materials that are typically used as wall or shell materials include proteins, polysaccharides, starches, waxes, fats, natural and synthetic polymers, and resins. Exemplary materials for use in the microencapsulation process used to form the microcapsules include gelatin, acacia (gum arabic), polyvinyl acetate, potassium alginate, carob bean gum, potassium citrate, carrageenan, potassium polymetaphosphate, citric acid, potassium tripolyphosphate, dextrin, polyvinyl alcohol, povidone, dimethylpolysiloxane, dimethyl silicone, refined paraffin wax, ethylcellulose, bleached shellac, modified food starch, sodium alginate, guar gum, sodium, sodium citrate, carboxymethylcellulose, hydroxypropyl cellulose, hydroxypropylmethylcellulose, sodium ferrocyanide, sodium polyphosphates, locust bean gum, methylcellulose, sodium trimetaphosphate, methyl ethyl cellulose, sodium tripolyphosphate, microcrystalline wax, tannic acid, petroleum wax, terpene resin, tragacanth, polyethylene, xanthan gum, and polyethylene glycol.

In some embodiments, for example, the shell of the microcapsules is configured such that one or more of the layers comprises a non-water soluble fatty acid. More particularly, when two layers are used to form the shell of the microcapsules, both layers may be formed of the non-water soluble fatty acid. Advantageously, use of a non-water soluble fatty acid for the shell provides microcapsules that are water insoluble and which will not substantially degrade due to contact with saliva in a user's mouth during use. Such configurations can be advantageous to provide for targeted release of the oral care additive. A targeted release can indicate that the oral care additive is only released under defined conditions. For example, a targeted release may exclude a release mode, such as being water-soluble or exhibiting water (or saliva) solubility. This can be advantageous to avoid loss of the oral care additive outside of the mouth, such as when rinsing the toothbrush.

In some embodiments, the microcapsules can be configured to be rupturable under typical tooth brushing forces. As used herein, "typical toothbrushing forces" generally refers to a normal amount of contact between the toothbrush bristles and a user's teeth and/or gums during use, which includes any mechanical or frictional forces transferred or applied to the toothbrush bristles (and the microcapsules therein) due to contact with the user's teeth and/or gums during brushing. As noted above, the plurality of microcapsules may be provided such that the shell of the microcapsules is not water soluble (e.g., when the shell layers comprise a non-water soluble fatty acid). Thus, mere contact with saliva in the mouth of a user that involves no physical contact with the user's teeth and/or gums would not be considered to provide the requisite "toothbrushing forces" necessary to rupture the microcapsules.

In some embodiments, the microcapsules themselves may have a defined size that is sufficiently small to be incorporated into the polymer fibers. For example, the microcapsules may have an average size of about 1 to about 10 microns, or about 2.5 to about 5 microns. In some embodiments, the microcapsules may have an average size of about 10 microns or less, about 7.5 microns or less, about 5 microns or less, or about 2.5 microns or less (e.g., down to a technologically feasible minimum).

In some embodiments, the shell of the microcapsules may have a defined melting point and the shell may be configured to resist melting during fiber extrusion techniques and temperatures as described herein. In embodiments where the shell comprises a plurality of layers (e.g., at least 2 layers, or at least 3 layers, or more), each of the plurality of layers of the shell of the microcapsules may have a defined melting point. For example, in embodiments wherein the shell has two layers, each layer of the shell can have a melting point of at least about 175° C., at least about 180° C., at least about 185° C., at least about 190° C., at least about 195° C., or at least about 200° C. In some embodiments, each layer of the shell may have a melting point in the range of about 175° C. to about 200° C., about 180° C. to about 195° C., or about 187° C. to about 191° C.

Further aspects of the present disclosure relate to methods of forming toothbrush bristles including an oral care additive, such bristles being suitable for use in the toothbrushes described herein above. As noted above, it has traditionally been difficult to incorporate various oral care additives into toothbrush bristles during the manufacturing process because exposure of said oral care additives to the elevated processing temperatures required can cause the oral care additive to break down and/or dissolve during manufacture of the bristles. However, the present disclosure advantageously provides improved methods and processes for incorporating oral care additives into toothbrush bristles during the manufacturing process of said bristles, such methods and processes can address the noted manufacturing difficulties in a variety of ways as will be discussed further herein.

In some embodiments, for example, methods of the present disclosure may include mixing a plurality of microcapsules with a flowable polymer to provide a mixture of the flowable polymer with the plurality of microcapsules included therein. Examples of suitable polymers include, but are not limited to, nylon and polybutylene terephthalate (PBT) and combinations thereof. In some embodiments, for example, the polymer fibers may comprise nylon, e.g., such as nylon 6.12 in particular. Typically, the polymer material (and the plurality of microcapsules mixed therewith) is made "flowable" by heating the polymer material to liquefy it, forming a flowable polymer material. In some embodiments, the polymer material (and the plurality of microcapsules mixed therewith) is heated to a temperature in the range of about 200° C. to about 300° C., about 220° C. to about 280° C., or about 240° C. to about 260° C. In some embodiments, the polymer material is heated to a temperature of at least about 200° C., at least about 220° C., at least about 240° C., at least about 260° C., or at least about 280° C.

In some embodiments, each of the plurality of microcapsules mixed with the flowable polymer may include an oral care additive surrounded by a shell configured as one or a plurality of layers. For example, any of the materials already disclosed herein may be used. Likewise, one or more of the materials may be excluded.

In some embodiments, the shell of the plurality of microcapsules is configured to resist melting during fiber extrusion techniques and temperatures. As noted herein, fiber extrusion techniques typically require elevated processing temperatures which can lead to difficulties during the manufacturing process (e.g., melting of the oral care additive during fiber extrusion). However, the inventors of the present application have discovered that these difficulties can be overcome in a variety of ways, for example, by providing a shell that has multiple layers or providing a shell that has a single layer having the thickness of two or more layers (i.e., double layer thickness), such that the shell, including the one or a plurality of layers, together provide a suitable amount of temperature resistance capable of preventing melting of the shell during fiber extrusion techniques and temperatures. In some embodiments, for example, the shell of the plurality of microcapsules may comprise a single layer (e.g., having a double layer thickness or multilayer thickness) configured to resist melting during fiber extrusion techniques and temperatures such that the encapsulated material is not released during such processing. In other embodiments, the shell of the plurality of microcapsules may comprise a plurality of layers configured to resist melting during fiber extrusion techniques and temperatures. In some embodiments, the amount of temperature resistance required to prevent melting of the shell during fiber extrusion techniques can be determined based on the processing temperature during fiber extrusion and is generally greater than the chosen temperature during extrusion. In such embodiments, the shell of the plurality of microcapsules, irrespective of the layer configuration, may have an overall melting point that is higher than the temperature during fiber extrusion.

In certain embodiments, the shell of the plurality of microcapsules may include two layers configured to resist melting during fiber extrusion techniques and temperatures. In some such embodiments, each of the two layers comprises a non-water soluble fatty acid having a defined melting point. For example, in embodiments wherein the shell has two layers, each layer of the shell can have a melting point of at least about 175° C., at least about 180° C., at least about 185° C., at least about 190° C., at least about 195° C., or at least about 200° C. In some embodiments, each layer of the shell may have a melting point in the range of about 175° C. to about 200° C., about 180° C. to about 195° C., or about 187° C. to about 191° C. The inventors of this application have discovered that use of a bi-layer fatty acid shell (each layer having an independent melting point of at least about 175° C.) advantageously provides a suitable amount of heat resistance/temperature shielding to prevent the plurality of microcapsules from dissolving and/or degrading and/or melting when subjected to the elevated temperatures required during heating of the polymer material and mixing with the plurality of microcapsules. It should be noted that such a configuration is not meant to be limiting and it is possible that use of a single layer shell having a double layer thickness or a shell having more than two layers or a shell formed of a material having a higher melting point may provide a suitable amount of heat resistance/temperature shielding to prevent the plurality of microcapsules from dissolving and/or degrading and/or melting when subjected to the elevated temperatures required during extrusion techniques.

In some embodiments, the methods according to the present disclosure comprise extruding the mixture of the flowable polymer with the plurality of microcapsules included therein to provide one or more solid filaments having the plurality of microcapsules included therein. Typically, fibers or filaments are formed using extrusion processes as commonly known in the art and various such processes may be suitable for use in methods described herein. In such processes, the plastic or polymer materials are typically heated to elevated temperatures to melt the plastic or polymer material and then extruded through an extrusion die to form individual filaments or fibers. In some embodiments, the one or more solid filaments may be extruded to provide polymer fibers in any form as described herein above. For example, the one or more solid filaments can be selected from single-component (i.e., uniform in composition throughout the fiber) or multicomponent fiber types including, but not limited to, polymer fibers having a sheath/core structure and polymer fibers having an islands-in-the-sea structure, as well as polymer fibers having a side-by-side, segmented pie, segmented cross, segmented ribbon, or tipped multilobal cross-sections Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired shape. Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or another take-up surface. In a continuous filament process, the strands are taken up on a godet which draws down the thin fluid streams in proportion to the speed of the take-up godet. In the jet process, the strands are collected in a jet, such as for example, an air gun, and blown onto a take-up surface such as a roller or a moving belt to form a spunbond web. In the meltblown process, air is ejected at the surface of the spinnerette which serves to simultaneously draw down and cool the thin fluid streams as they are deposited on a take-up surface in the path of cooling air, thereby forming a fiber web. Regardless of the type of melt spinning procedure which is used, the thin fluid streams may be melt drawn down in a molten state, i.e. before solidification occurs to orient the polymer molecules for good tenacity. Typical melt draw down ratios known in the art may be utilized. Where a continuous filament or staple process is employed, it may be desirable to draw the strands in the solid state with conventional drawing equipment, such as, for example, sequential godets operating at differential speeds. Following drawing in the solid state, the continuous filaments may be crimped or texturized and cut into a desirable fiber length, thereby producing staple fiber. The length of the staple fibers generally ranges from about 25 to about 50 millimeters, although the fibers can be longer or shorter as desired. Extrusion methods and methods of making multicomponent fibers are well known and need not be described here in more detail. Examples of extrusion methods and methods of making multicomponent fibers are described in U.S. Pat. No. 5,698,322 to Tsai et al. and U.S. Pat. No. 7,056,580 to Dugan, the disclosures of which are incorporated herein by reference in their entirety.

In some embodiments, one or more solid filaments having the plurality of microcapsules included therein may preferably have a multicomponent arrangement that is either a sheath/core arrangement or an islands-in-the-sea arrangement. Referring back to FIGS. 2B and 2C, for example, it is noted that the plurality of microcapsules 210 may be positioned completely within the core component 204 for a sheath/core extruded product (see, e.g., FIG. 2B) and the plurality of microcapsules 210 may be positioned completely within the inner island components 206 for an islands-in-the-sea arrangement (see, e.g., FIG. 2C). As noted above, the inventors of the present application discovered that positioning the plurality of microcapsules within the core and/or inner island component of the multicomponent fibers advantageously provides improved manufacturability of the polymer fibers during the heating and extrusion process. For example, during processing, the plurality of microcapsules exhibited some degradation and release of the oral care additive contained therein when the plurality of microcapsules were positioned in the outer sheath component rather than the core component, or when the plurality of microcapsules were included in a single-component. It is believed that such degradation was caused due to the degree of exposure to elevated temperature at the outer surface of the fibers and/or due to frictional shear created at the outer surface of the fibers during the extrusion process. Further, without intending to be bound by theory, it is believed that the outer sheath of the polymer fibers provided some degree of additional temperature resistance when the plurality of microcapsules were positioned completely within the inner core component.

In some embodiments, methods according to the present disclosure may further comprise forming the plurality of microcapsules prior to mixing the plurality of microcapsules with the flowable polymer. As noted herein above, the microcapsules may be formed using any food-grade encapsulation method commonly known in the art. Examples of food-grade microencapsulation processes are described, for example, in U.S. Pat. No. 9,936,726 to Braga et al. and U.S. Pat. No. 5,418,010 to Janda et al., both of which are incorporated herein by reference in their entirety. Likewise, the further encapsulation methods already noted herein may be utilized.

FIG. 4A and FIG. 4B provide Scanning Electron Microscopy (SEM) images showing a plurality of microcapsules at different magnifications (FIG. 4B being at a greater magnification than FIG. 4A), each of the microcapsules having an encapsulated oral care additive surrounded by a shell. FIG. 5 is an enlarged cut-away view illustrating a portion of a polymer fiber 400 having a plurality of microcapsules 402 positioned within at least a portion of the polymer fiber 400. As noted above, the microcapsules themselves may have a defined size that is sufficiently small to be incorporated into the polymer fibers in some embodiments. For example, the microcapsules may have an average size of about 1 to about 10 microns, or about 2.5 to about 5 microns. In some embodiments, the microcapsules may have an average size of about 10 microns or less, about 7.5 microns or less, about 5 microns or less, or about 2.5 microns or less.

In some embodiments, methods according to the present disclosure may further comprise milling the oral care additive prior to being encapsulated to provide particles of the oral care additive that are of sufficiently small size to be incorporated into the polymer fibers. In some embodiments, the oral care additive, such as sodium bicarbonate, may have an average particle size in the range of about 1 to about 10 microns, or about 2.5 to about 5 microns. In some embodiments, the oral care additive, such as sodium bicarbonate, may have an average particle size of about 10 microns or less, about 7.5 microns or less, about 5 microns or less, or about 2.5 microns or less.

Use of the words "about" and "substantially" herein are understood to mean that values that are listed as "about" a certain value or "substantially" a certain value may vary by an industry recognized tolerance level for the specified value. When an industry recognized tolerance is unavailable, it is understood that such terminology may indicate that an acceptable value may be vary ±3%, ±2%, or ±1% from the specifically listed value.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A toothbrush comprising: a brush head; a plurality of bristles in the form of polymer fibers attached to the brush head; and a plurality of microcapsules positioned within at least a portion of the polymer fibers, each microcapsule of the plurality of microcapsules comprises an oral care additive surrounded by a shell that includes two layers configured such that each of the two layers has a melting point of about 175ºC or greater, the plurality of the microcapsules being positioned within each of the polymer fibers.

2. The toothbrush of claim 1, wherein the polymer fibers are formed of a polymer selected from the group consisting of nylon, polybutylene terephthalate (PBT), or a combination thereof.

3. The toothbrush of claim 1, wherein the oral care additive comprises sodium bicarbonate.

4. The toothbrush of claim 3, wherein the sodium bicarbonate has an average particle size of about 5 microns or less.

5. The toothbrush of claim 1, wherein the microcapsules have an average size of about 5 microns or less.

6. The toothbrush of claim 1, wherein the shell comprises a non-water soluble fatty acid.

7. The toothbrush of claim 1, wherein the shell of the plurality of microcapsules is rupturable under typical tooth brushing forces.

8. The toothbrush of claim 1, wherein the shell of the plurality of microcapsules is not water soluble.

9. The toothbrush of claim 1, wherein the polymer fibers are multicomponent fibers.

10. The toothbrush of claim 9, wherein the multicomponent fibers comprise an outer sheath or matrix component and an inner core component or a plurality of island components, such that the multicomponent fibers are in a sheath/core arrangement or an islands-in-the-sea arrangement, respectively.

11. The toothbrush of claim 10, wherein the plurality of microcapsules positioned within at least a portion of the polymer fibers is positioned within the inner core component or the plurality of island components.

12. The toothbrush of claim 10, wherein the outer sheath or matrix component and the inner core component or plurality of island components are formed of the same or different polymer fibers.

13. The toothbrush of claim 1, wherein the plurality of bristles is attached to the brush head or a component thereof.

14. A toothbrush comprising: a brush head; a plurality of bristles in the form of polymer fibers attached to the brush head; and a plurality of microcapsules positioned within at least a portion of the polymer fibers, each microcapsule of the plurality of microcapsules comprises an oral care additive surrounded by a shell configured as one or a plurality of layers, the plurality of the microcapsules being positioned within each of the polymer fibers, wherein the oral care additive comprises sodium carbonate that has an average particle size of about 5 microns or less.

15. A toothbrush comprising: a brush head; a plurality of bristles in the form of polymer fibers attached to the brush head; and a plurality of microcapsules positioned within at least a portion of the polymer fibers, each microcapsule of the plurality of microcapsules comprises an oral care additive surrounded by a shell configured as one or a plurality of layers, the plurality of the microcapsules being positioned within each of the polymer fibers, and the microcapsules having an average size of about 5 microns or less.

* * * * *